US006173874B1

(12) United States Patent
Stein et al.

(10) Patent No.: US 6,173,874 B1
(45) **Date of Patent: *Jan. 16, 2001**

(54) CARRYING SYSTEM FOR A SELF STANDING GOLF BAG

(75) Inventors: Louis "Cobi" Stein, Holyoke; Chuck Heidenreich, Westfield, both of MA (US)

(73) Assignee: Spalding Sports Worldwide, Inc., Chicopee, MA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/009,038

(22) Filed: Jan. 20, 1998

Related U.S. Application Data

(63) Continuation-in-part of application No. 08/796,761, filed on Feb. 6, 1997.

(51) Int. Cl.[7] ..... A45F 9/04

(52) U.S. Cl. ..... 224/645; 224/264; 224/259; 224/614; 206/315.3; 206/315.7; 267/70

(58) Field of Search ..... 224/645, 643, 224/264, 257, 258, 613, 614, 616, 617, 259; 267/69, 70, 71, 72, 73, 74; 206/315.3, 315.6, 315.7

(56) References Cited

U.S. PATENT DOCUMENTS

| | | | | |
|---|---|---|---|---|
| 1,388,241 | * | 8/1921 | Dierking | 267/70 |
| 1,570,500 | * | 1/1926 | Kennedy | 224/645 |
| 1,764,750 | * | 6/1930 | Richter | 267/70 |
| 5,042,654 | | 8/1991 | Jones . | |
| 5,042,704 | | 8/1991 | Izzo . | |
| 5,429,288 | | 7/1995 | Sattler . | |
| 5,501,328 | * | 3/1996 | Keller et al. | 206/315.6 |
| 5,558,259 | | 9/1996 | Izzo . | |
| 5,577,648 | * | 11/1996 | Sason et al. | 224/643 |
| 5,593,077 | | 1/1997 | Izzo . | |
| 5,615,811 | * | 4/1997 | Bell et al. | 224/258 |
| 5,829,719 | * | 11/1998 | Han | 206/315.7 |

* cited by examiner

*Primary Examiner*—Allan N. Shoap
*Assistant Examiner*—Tri M. Mai

(57) ABSTRACT

The bag of the present invention is a self standing bag having a pair of pivotal legs secured proximate its upper extent. These legs are adapted to be retracted when the bag is lifted from the ground. A pair of straps enable the bag to be carried upon both shoulders of a user in a backpack style. Additionally, in order to ease the weight of the bag upon a user, the each of the straps is partially filled with a gel. Furthermore, the upper portion of each of the straps is secured to the bag by way of a shock absorber. This shock absorber includes upper and lower components which are interconnected by a pair of springs.

1 Claim, 5 Drawing Sheets

CARRYING SYSTEM FOR A SELF STANDING GOLF BAG

RELATED APPLICATION DATA

This is a Continuation-in-part of co-pending application Ser. No. 08/796,761 filed Feb. 6, 1997 to Stein.

BACKGROUND OF THE INVENTION

1. Field of the Invention

The present invention relates to a golf bag and more particularly pertains to a golf bag employing a carrying strap system for reducing stress upon the shoulders of a user.

2. Description of the Prior Art

The use of golf bag carrying straps is known in the prior art. Additionally, golf bags employing dual carrying straps have recently become quite popular. Such carrying straps, however, are known to consist of expected and obvious structural configurations, notwithstanding the myriad of designs encompassed by the crowded prior art which have been developed for the fulfillment of countless objectives and requirements.

By way of example, U.S. Pat. No. 5,593,077 to Izzo discloses a shoulder-born carrying strap assembly for carrying golf clubs. U.S. Pat. Nos. 5,558,259 and 5,042,704 to Izzo each disclose a golf bag with dual carrying straps. U.S. Pat. No. 5,429,288 to Sattler discloses a supplemental carry strap for a golf bag. Lastly, U.S. Pat. No. 5,042,654 to Jones discloses a golf bag having a hand grip located within its base.

None of these prior art references illustrates a dual strap system specifically designed to reduce stress upon the shoulders of a user through the combination of shock absorbers and gel inserts. In this respect, the carrying strap system of the present invention substantially departs from the conventional concepts and designs of the prior art, and in so doing provides an apparatus primarily developed for the purpose of reducing stress upon the shoulders of a user.

Therefore, it can be appreciated that there exists a continuing need for improved carrying arrangements for golf bags. In this regard, the present invention substantially fulfills this need.

SUMMARY OF THE INVENTION

In view of the foregoing disadvantages inherent in the known types of carrying arrangements now present in the prior art, the present invention provides an improved carrying system for a standing bag. The system employs dual gel filled straps which are joined to a shock absorber. As such, the general purpose of the present invention, which will be described subsequently in greater detail, is to reduce the stresses a golf bag places upon the shoulders of a user.

To attain this, the present invention essentially comprises a self standing bag having a pair of pivotal legs secured proximate its upper extent. These legs are adapted to be retracted when the bag is lifted from the ground. A pair of straps enable the bag to be carried upon both shoulders of a user in a backpack style. Additionally, in order to ease the weight of the bag upon a user, the each of these straps is partially filled with a gel material. Furthermore, the lower portion of each of the straps is secured to the bag by way of a shock absorber. This shock absorber includes upper and lower components which are interconnected by a pair of springs.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf bag strap system for use with a self standing golf bag. The system is for use in conjunction with a golf bag having a rigid lower end, a rigid upper opened end and an intermediate extent therebetween. A pivotal foot is secured to the lower end of the bag, and a pair of legs having upper ends are pivotally interconnected proximate the opened end of the bag. Additionally, a pair of actuation rods are interconnected between the upper ends of the legs and the pivotal foot. These legs have a first retracted orientation corresponding to an unpivoted orientation of the foot, and a second pivoted orientation wherein the legs are extended corresponding to the pivoted orientation of the foot. A spring plunger is included having a lower end secured to the intermediate extent of the golf bag. The upper end of the plunger takes the form of a rectangular buckle, with the rectangular buckle having an upper rectangular housing secured thereto. The plunger also includes a lower rectangular buckle and an associated lower rectangular housing. The upper and lower housings are slidably interconnected, with a pair of springs being positioned intermediate the upper and lower housing. Thus, movement of the upper and lower buckles causes each of the springs to be compressed. A pair of bag straps are included with each of the straps having an upper end, a lower end and an intermediate extent therebetween. The lower ends of the straps are secured to the upper buckle, and the upper ends of the straps are secured proximate the upper opened end of the golf bag opposite the upper ends of the pair of legs. Additionally, each of the intermediate extents are formed into a number of segments with a central elongated segment. Each of the central elongated segments has a bladder with a gel filled interior. Lastly, a divider is positioned within the upper opened end of the bag. The divider has arcuate upper and lower dividers interconnected by a central divider.

It is another object of the present invention to provide a carrying strap arrangement which allows any forces applied to the strap to be absorbed by a spring mechanism.

It is a further object of the present invention to provide a dual strap wherein each strap is filled with a gel material.

An even further object of the present invention is to provide a bag with an upper divider for distributing the weight of the clubs stored within the bag.

Still another object of the present invention is to create a carrying strap system which is specifically adapted to be used in conjunction with a self standing golf bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
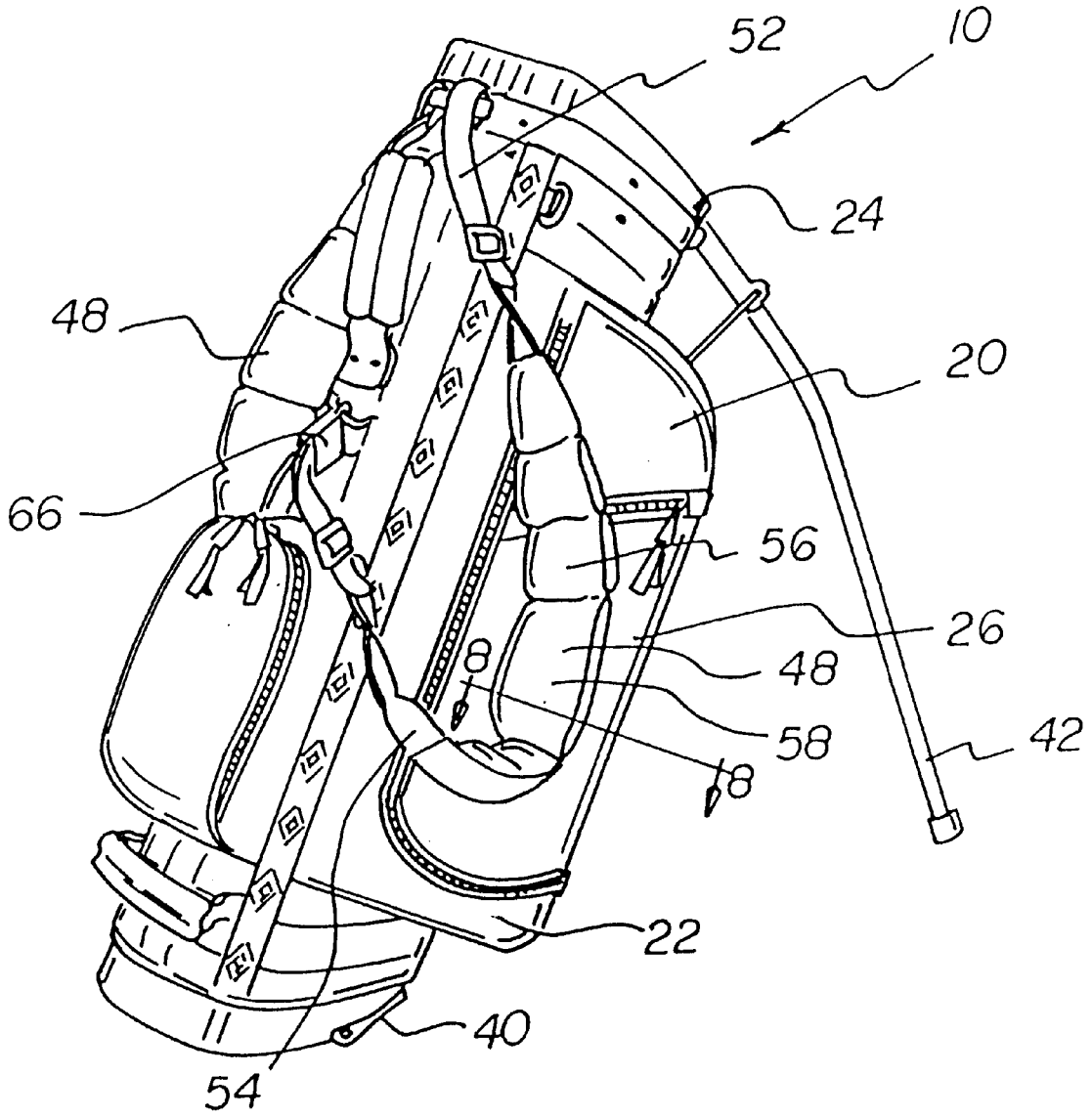
FIG. 1 is a perspective view of the golf bag of the present invention.

With reference now to the drawings, and in particular to FIG. 1 thereof the golf bag system 10 of the present invention is depicted. The bag is self standing having a pair of pivotal legs secured proximate its upper extent. These legs are adapted to be retracted when the bag is lifted from the ground. A pair of straps enable the bag to be carried upon both shoulders of a user in a backpack style. Additionally, in order to ease the weight of the bag upon a user, the each of the straps is partially filled with a gel material. Furthermore, the lower portion of each of the straps is secured to the bag by way of a shock absorber. This shock absorber includes upper and lower components which are interconnected by a pair of springs. The various components of the present invention, and the manner in which they interrelate, will be described in greater detail hereinafter.

Figure 2:
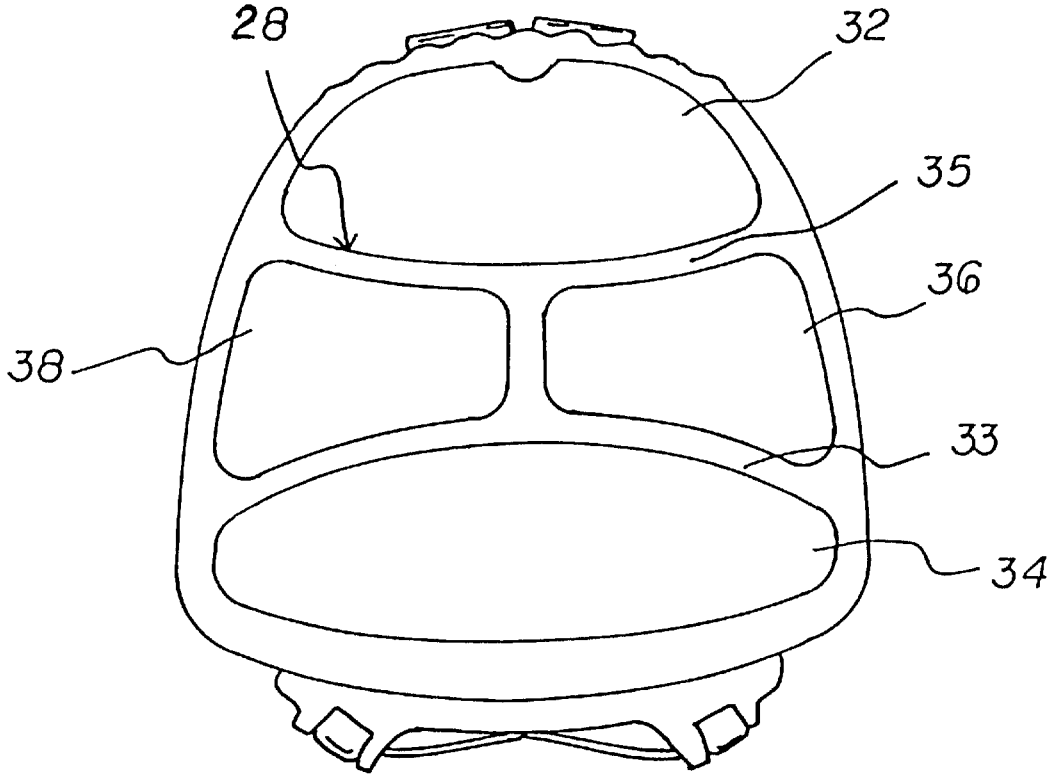
FIG. 2 is a view of the upper opened portion of the golf bag.

The bag 20 is defined by a rigid lower end 22, a rigid upper opened end 24 with an intermediate extent 26 therebetween. With reference to FIG. 2, the opened upper end 24 of the bag is more clearly illustrated. Additionally, a divider 28 which is positioned within the upper opened end 24 of the bag serves to divide it into four components: an upper component 32, a lower component 34, a right side component 36, and a left side component 38. As indicated in FIG. 2, the lower component 34 is the component closest to the upper ends of the pivotal legs of the bag. Each of the components has a shape which is specifically adapted to equally distribute the weight of any clubs contained within the golf bag 20. To achieve this, the divider has arcuate upper and lower dividers, 35 and 33 respectively, are interconnected by a central divider. With continuing reference to FIG. 2, the optimal weight distributing shape is achieved with the lower divider 33 opening toward the lower end of the opening 24, and the upper divider 35 opening toward the upper end. The resulting shape of each of the components is designed to evenly space the clubs within the bag while the bag is being carried.

Figure 3:
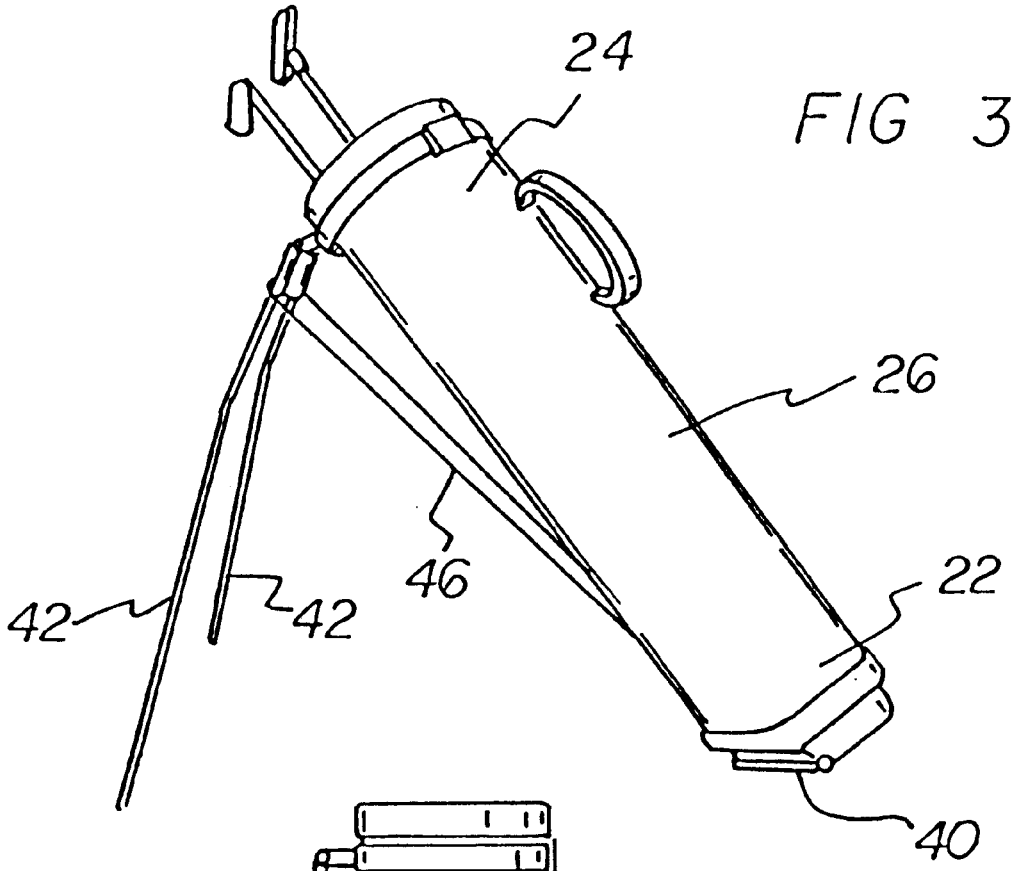
FIG. 3 is a perspective view of the bag stand of the present invention.
Figure 4:
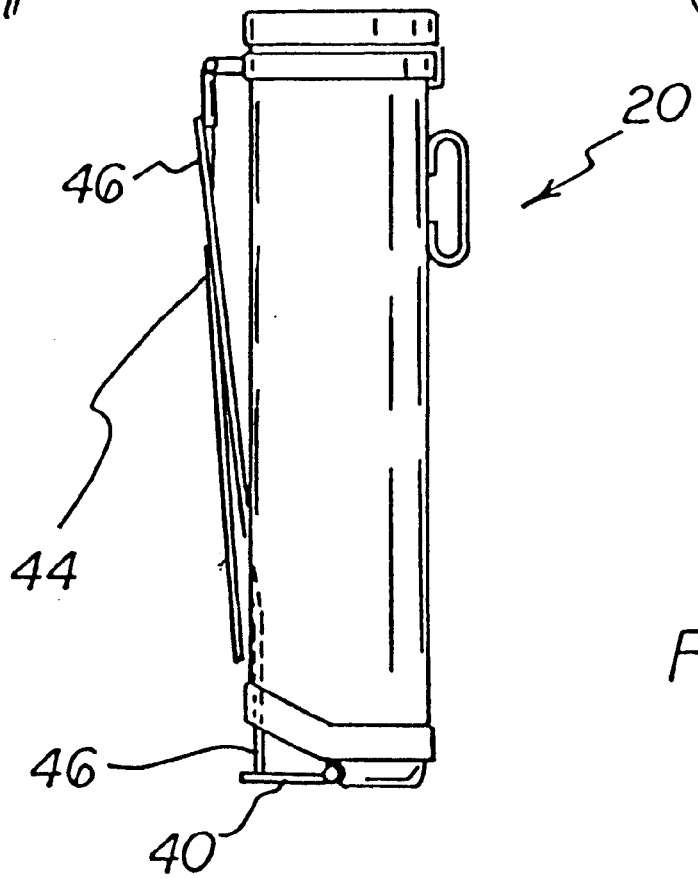
FIG. 4 is a side view of the bag stand of the present invention.

The bag stand of the present golf bag will next be described. The bag stand described is essentially the same as that described in co-pending application Ser. No. 08/982,558 to Stein et al. and entitled "Automatic Golf Bag Support Stand", incorporated herein by reference. Such bag stand operates by way of a pivotal foot 40 which is secured to the lower end 22 of the bag 20, and a pair of pivotal legs 42. Each of the legs 42 has an upper end 44 which is pivotally interconnected proximate the opened end 24 of the bag 20. FIGS. 3 and 4 together illustrate the essential features of the bag stand of the present invention with the straps and other features removed for clarity. With continuing reference to FIGS. 3 and 4, the pair of actuation rods 46 of the bag stand are also illustrated. These rods 46 are interconnected between the upper ends of the legs 42 and the pivotal foot 40, with the lower ends of the rods extending through apertures within the lower end of the bag. The legs 42 have a first retracted orientation. In this orientation the legs 42 are positioned proximate to the golf bag 20 in a manner depicted in FIG. 4. This first orientation corresponds to the unpivoted orientation of the foot 40. Additionally, the legs 42 have a second pivoted orientation wherein the legs 42 are extended away from the bag 20. As illustrated in FIG. 3, this second orientation corresponds to the pivoted orientation of the foot 40. Thus, when a user places the bag upon the ground, the foot 40 is pivoted and the legs 42 extend outwardly being urged by the actuation rods 46. Alternatively, when the bag is picked up and carried the tendency of the actuation rods 46 to maintain a linear orientation forces them downwardly and the legs 42 thus retract.

Figure 7:
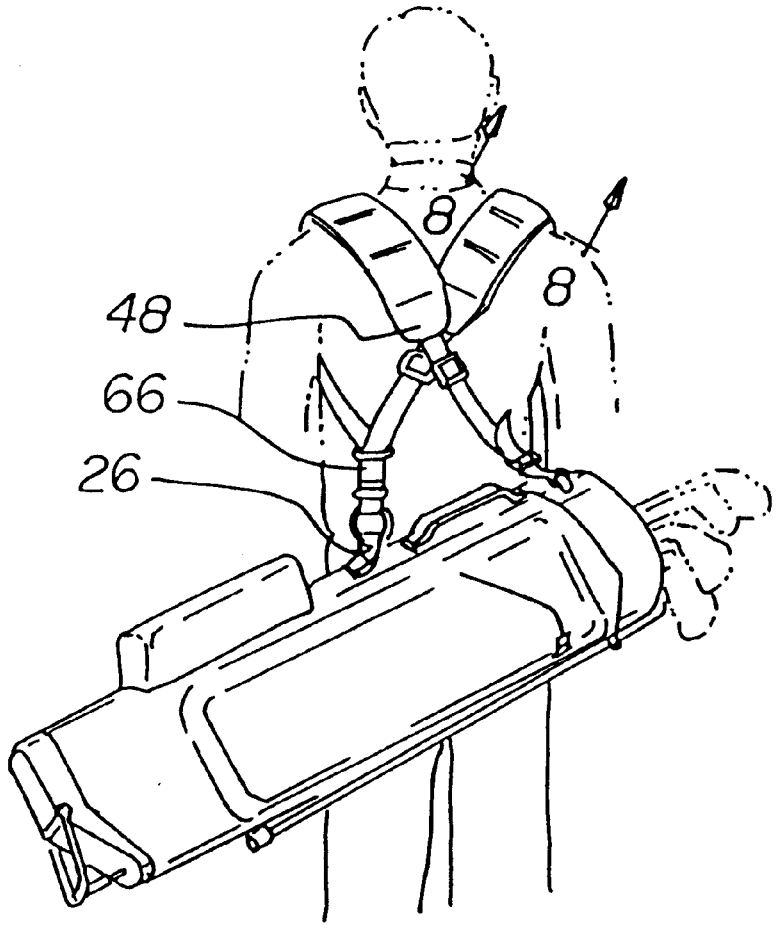
FIG. 7 is a view of the straps as worn by a user.
Figure 8:
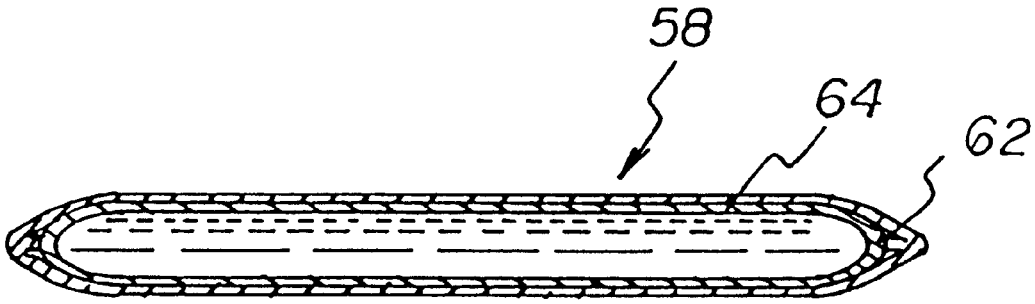
FIG. 8 a view taken along line 8—8 of FIG. 7.

The bag 20 of the present invention employs dual carrying straps 48. Through the use of a dual strap arrangement the bag 20 can be worn by a user backpack style. FIG. 7 illustrates the dual strap as worn by a user. The dual strap 48 itself is illustrated with reference to FIG. 1. Each of the pair of bag straps 48 is defined by an upper end 52, a lower end 54 and an intermediate extent 56 therebetween. The upper ends 52 of the straps are each secured proximate the upper end 24 of the bag 20 via an integrally formed attachment handle. The lower ends 54 of the straps 48 are secured to the intermediate extent of the golf bag 20 via a shock absorber in a manner more fully described hereinafter. With continuing reference to FIG. 1, each of the intermediate extents 56 is formed into a number of segments. In the preferred embodiment, there are five such segments within each strap. Additionally, the central most segment is an elongated segment 58. Typically, when the bag is being carried the central segments 58 are oriented over the shoulders of a user.

Each of the central elongated segments 58 has a bladder 62 with a gel filled interior 64. The gel filled interior 64 of the central segments 58 helps in distributing and relieving the weight of the golf bag 20 upon the shoulders of a user. The preferred gel material is a composite mixture of a lightly lubricated micro-sphere material available under the trademark FLOAM. This material is more fully described in U.S. Pat. No. 5,549,743 to Pearce incorporated herein by reference. Other gel materials, however, could be employed to achieve the objects of the present invention.

Figure 5:
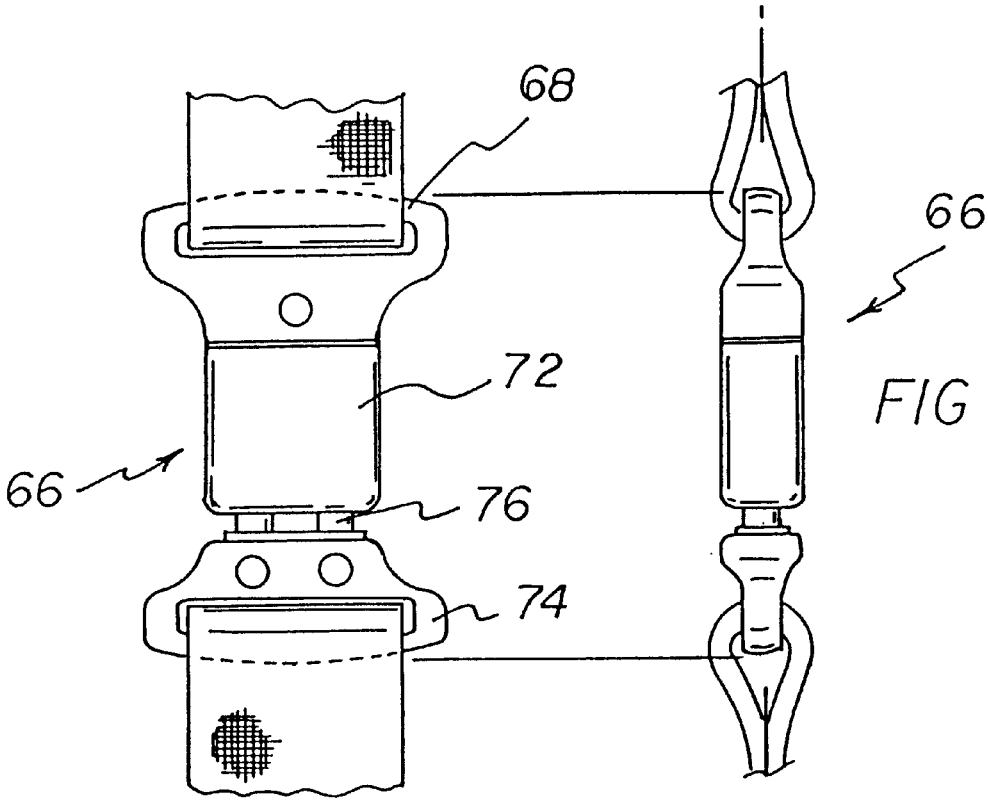
FIG. 5 is a view of the shock absorber employed in the present invention.

The upper extents 52 of each of the straps 48 is secured proximate the upper end 24 of the golf bag 20 via an integrally formed attachment handle, opposite the upper extents of the pair of legs. Additionally,the lower ends of the straps are secured to a shock absorber 66. The shock absorber 66 is depicted in FIG. 5, and has a lower end which is secured to the intermediate extent 26 of the golf bag 20. The upper end of the shock absorber takes the form of a rectangular buckle 68. This rectangular buckle 68 has an upper rectangular housing 72 secured thereto. The shock absorbers likewise include a lower rectangular buckle 74 and an associated lower plungers 76. The upper housing and lower plungers are slidably interconnected. In the preferred embodiment, this is achieved via a slot formed within the upper housing and into which the plungers are slidably received. With continuing reference to FIG. 5, a pair of springs 78 are positioned within the upper housing and around the plungers in a side by side parallel fashion. Thus, movement of the upper and lower buckles 74 and 76 away from one another causes each of the springs to be compressed. Through the use of the shock absorber, any movements of the bag while being carried are minimized. The shock absorber described is similar to that described in co-pending Application Ser. No. 08/796,761 to Stein incorporated herein by reference.

Figure 6:
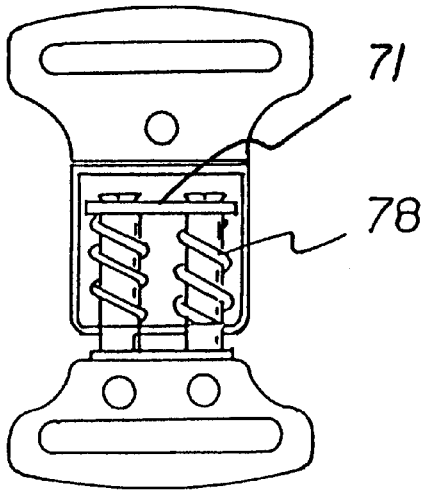
FIG. 6 is a plan view of the shock absorber of the present invention illustrating the internal springs.

More specifically, as seen in FIGS. 5 and 6, a shock absorber 66 is first provided. The shock absorber includes a lower rectangular buckle 74 secured with respect to the bag. Two parallel side by side plungers 76 extend upwardly therefrom. Note FIG. 6. An upper rectangular buckle 68 is next provided. A strap is mounted on the upper rectangular buckle 68. An upper rectangular housing 72 extends downwardly from the upper rectangular buckle. A slot is provided in the lower end of the upper rectangular housing and is adapted for the slidable receipt of the plungers. A cross member 71 couples the upper ends of the plungers. The plungers and the upper rectangular housing are slidably coupled together within the cross member. A coil spring 78 is provided around each of the plungers. The upper ends of the coil springs are in contact with the cross member and lower ends of the coil springs are in contact with the upper rectangular housing adjacent to the slot for urging the upper rectangular buckle and lower rectangular buckle together. Note FIG. 6.

Thus, in user a user picks up the bag 20 by lifting on one or more of the straps 48. Lifting of the straps 48 causes compression of the springs of the shock absorber 66 until a steady state is achieved. The user then places each strap 48 over a shoulder. In this orientation, each of the central gel filed segments is centered over one of the user's shoulders. While walking any forces acting upon the bag are absorbed both by the gel material and the compression springs of the plunger.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf bag strap system for use with a self standing golf bag, the system comprising in combination:

a golf bag having a rigid lower end, a rigid upper opened end and an intermediate extent therebetween, a pivotal foot secured to the lower end of the bag, a pair of legs having upper ends pivotally interconnected proximate the opened end of the bag, a pair of actuation rods interconnected between the upper ends of the legs and the pivotal foot, the legs having a first retracted orientation corresponding to an unpivoted orientation of the foot, and a second pivoted orientation wherein the legs are extended corresponding to the pivoted orientation of the foot;

a shock absorber having a lower buckle secured with respect to the bag with two parallel side by side plungers extending upwardly therefrom and an upper buckle having a strap mounted thereon for being supported by a user, the upper buckle assembly having an upper rectangular housing extending downwardly therefrom with a slot in the lower end thereof for the slidable receipt of the plungers, a cross member coupling the upper ends of the plungers, wherein the plungers and upper rectangular housing are slidably coupled together, and a coil spring around each of the plungers with upper ends of the plungers in contact with the cross member and lower ends in contact with the upper rectangular housing adjacent to the slot for urging the upper buckle and lower buckle together;

a pair of bag straps, each of the straps having an upper end, a lower end and an intermediate extent therebetween, the lower ends of the straps being secured to the upper buckle, the upper ends of the straps being secured proximate the upper end of the golf bag, each of the intermediate extents being formed into a number of segments with a central elongated segment, each of the central elongated segments having a bladder with a gel filled interior; and a divider positioned within the upper opened end of the bag, the divider having arcuate upper and lower dividers interconnected by a central divider.

* * * * *